United States Patent [19]

Franzen

[11] 3,945,184

[45] Mar. 23, 1976

[54] SELF-THREADING YARN BRAKE MECHANISM IN A HOLLOW SPINDLE ASSEMBLY OF A TEXTILE YARN PROCESSING MACHINE

[75] Inventor: Gustav Franzen, Krefeld, Germany

[73] Assignee: Palitex Project Company GmbH, Germany

[22] Filed: Apr. 4, 1975

[21] Appl. No.: 565,059

[52] U.S. Cl. ..... 57/58.86; 57/34 R; 57/58.7; 57/106; 242/149

[51] Int. Cl.[2] ..... D01H 7/86; D01H 13/10

[58] Field of Search..... 57/34 R, 58.7, 58.83, 58.86, 57/106; 242/128, 149, 157 R, 157 C

[56] References Cited

UNITED STATES PATENTS

| | | | |
|---|---|---|---|
| 3,490,221 | 1/1970 | Heimes et al. | 57/58.86 |
| 3,731,478 | 5/1973 | Franzen | 57/58.7 |
| 3,754,389 | 8/1973 | Nakahara et al. | 57/58.83 |
| 3,783,597 | 1/1974 | Greive et al. | 57/58.86 X |

*Primary Examiner*—John Petrakes
*Attorney, Agent, or Firm*—Bell, Seltzer, Park & Gibson

[57] ABSTRACT

A textile yarn processing machine, such as a two-for-one twister and the like, having spindle assemblies for the processing of yarn and each including a carrier mechanism for carrying a pacakge of yarn to be withdrawn and processed and defining a passageway therethrough for yarn withdrawn from the package and an enlarged cavity forming a part of the passageway, includes the combination therewith of an improved, self-threading, yarn brake mechanism positioned in the cavity, as follows. A stationary braking member forms an inclined braking surface generally around the passageway at the entrance to the cavity and a movable braking plate cooperates therewith and generally covers the passageway at the entrance to the cavity and is adjustably biased toward the inclined braking surface for applying a desired tension to the yarn passing therebetween. A yarn bypass channel leads from the passageway at the entrace to the cavity laterally alongside the stationary braking surface for receiving the yarn and eliminating passage of the yarn between the braking surface and braking plate during threading of the yarn through the passageway for start-up of the spindle assembly. An obliquely extending deflection surface extends between the bypass channel and the inclined braking surface for deflecting the yarn from the bypass channel into position between the braking surface and the braking plate after threading of the yarn for start-up of the spindle assembly.

10 Claims, 9 Drawing Figures

SELF-THREADING YARN BRAKE MECHANISM IN A HOLLOW SPINDLE ASSEMBLY OF A TEXTILE YARN PROCESSING MACHINE

This invention relates to an improved, self-threading, yarn brake mechanism in an enlarged cavity of a yarn passageway through a carrier mechanism of a spindle assembly of a textile yarn processing machine, particularly a two-for-one twister.

BACKGROUND OF THE INVENTION

Heretofore, yarn brake mechanisms positioned in an enlarged cavity of a yarn passageway in a hollow carrier mechanism of a spindle assembly of a textile yarn processing machine, particularly a two-for-one twister, have been proposed, such as shown in U.S. Pat. No. 3,490,221, issued Jan. 20, 1970, and assigned to the assignee of the present invention, and reference may be had to that patent for a disclosure of such prior yarn brake mechanisms. As may be seen in the aforementioned U.S. Pat. No. 3,490,221, this prior yarn brake mechanism included broadly a stationary, inclined, braking surface and a movable, pivotally mounted, braking plate for cooperation therewith and for receiving the yarn therebetween for applying a desired tension to the yarn as it passes through a hollow yarn carrier mechanism of a spindle assembly of the two-for-one twister textile yarn processing machine.

While this previously proposed yarn brake mechanism has been commercially effective for applying desired tensions to the yarn as it is being processed in the yarn processing machine, it required positive movement of the movable braking plate away from the stationary braking surface during threading of the yarn through the spindle assembly for start-up of the spindle assembly prior to yarn processing which was somewhat undesirable. Additionally, with the advent of automatic threading mechanisms for such spindle assemblies of textile yarn processing machines, such as, for example, disclosed in U.S. Pat. No. 3,731,478, issued May 8, 1973, and assigned to the assignee of the present invention, this requirement for positive movement of the movable braking plate away from the stationary braking surface, during threading of the yarn through the spindle assembly for start-up of the spindle assembly, has caused additional problems in the use of such automatic threading mechanisms.

OBJECTS AND SUMMARY OF THE INVENTION

Accordingly, it is the object of this invention to provide an improved yarn brake mechanism for use in such, above described, spindle assemblies of a textile yarn processing machine, which eliminates the above described problems by eliminating the necessity for positive movement of the movable braking plate away from the stationary braking surface during threading of the yarn through the spindle assembly for start-up of the spindle assembly and which is characterized by a self-threading construction.

It has been found by this invention that the above described object may be accomplished by providing, in a textile yarn processing machine, such as a two-for-one twister and the like, having spindle assemblies for the processing of yarn and each including a carrier mechanism for carrying a package of yarn to be withdrawn and processed and defining an elongate passageway therethrough for the yarn withdrawn from the package and an enlarged cavity forming a part of and enlarging the passageway at the cavity, the combination therewith of an improved yarn brake mechanism positioned in the cavity for applying a desired tension to the yarn passing therethrough and being characterized by a self-threading construction, as follows.

A stationary braking member is positioned in the upper portion of the cavity and forms a generally flat, inclined braking surface generally around the passageway at the entrance to the cavity. A movable braking plate is pivotally mounted within the cavity for cooperation with the stationary braking surface and for generally covering the passageway at obliquely entrance to the cavity and includes means for adjustably biasing the braking plate toward the inclined braking surface for applying a desired tension to the yarn passing therebetween during processing. A yarn bypass channel is formed in the stationary braking member and leads from the passageway at the entrance to the cavity laterally alongside the stationary braking surface for receiving the yarn during the threading of the yarn through the passageway for start-up of the spindle assembly prior to yarn processing and eliminates passage of the yarn between the braking surface and the braking plate during such threading. An obiliquely extending, deflection surface is formed in the stationary braking member between the bypass channel and the inclined braking surface for deflecting the yarn from the bypass channel into position between the braking surface and braking plate after threading of the yarn and during start-up of the spindle assembly.

Further specific features of the improved, self-threading, yarn brake mechanism of this invention will become apparent from the detailed description of the preferred embodiments, to follow.

BRIEF DESCRIPTION OF THE DRAWINGS

Some of the objects and advantages of this invention having been set forth, other objects and advantages will appear, when taken in conjunction with the accompanying drawings, in which.

DESCRIPTION OF PREFERRED EMBODIMENT

While the drawings and specific description to follow will be related to a two-for-one twister yarn processing machine, which is the preferred form of machine utilizing the improved yarn brake mechanism of this invention, it is to be understood that the improved yarn brake mechanism of this invention could be utilized with other types of yarn processing machines for which a yarn brake mechanism for controlling the tension of the yarn is desired in a hollow carrier member of a spindle assembly.

Figure 1:
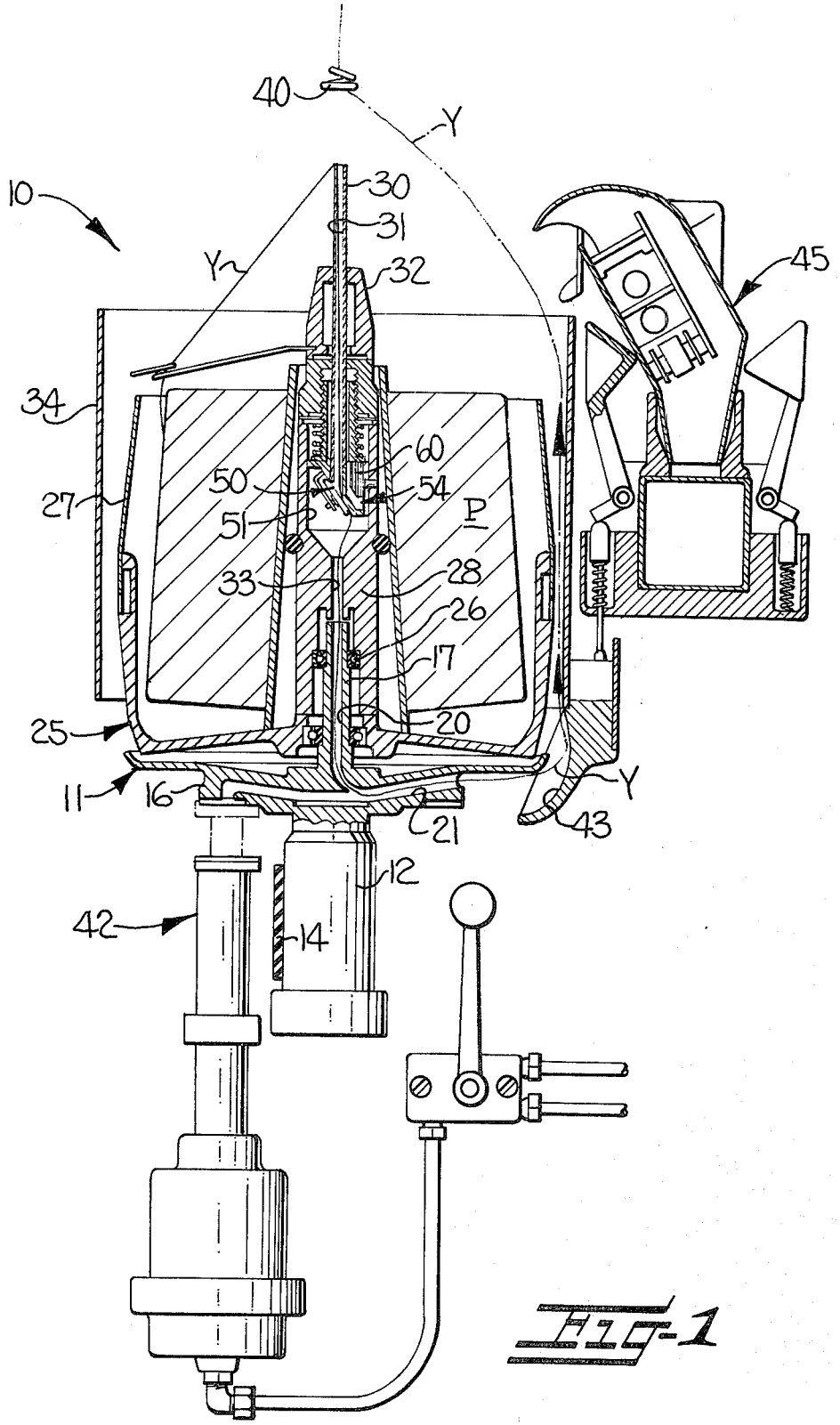
FIG. 1 is a partial, cross-sectional, elevational view of a spindle assembly of a two-for-one twister yarn processing machine having an improved, self-threading, yarn brake mechanism therein in accordance with this invention.

Referring now to the drawings, there is illustrated in FIG. 1 a spindle assembly 10 at one spindle assembly station of a two-for-one twister yarn processing machine. It is to be understood that a plurality of these spindle assembly stations are provided in generally side-by-side relationship in two rows along the outside of the yarn processing machine. A full illustration and description of the entire two-for-one twister yarn processing machine is not given herein and is not believed to be necessary for an understanding of the present invention, the operation and structure of such a two-for-one twister yarn processing machine being well understood by those with ordinary skill in the art.

Generally, each of the spindle assemblies 10 comprises a rotatably driven rotor mechanism, generally indicated at 11, which includes a whorl 12 suitably rotatably mounted on the twister machine frame (not shown) and rotated by a continuous drive belt 14 in a manner well known to those with ordinary skill in the art. The rotor mechanism 11 further includes a generally horizontally-extending reserve disc 16 secured to the whorl 12 for being rotated thereby and a generally vertically-extending hollow axle 17. The reserve disc 16 and hollow axle 17 define a generally vertically extending yarn passageway 20 extending through the hollow axle 17 and partly through the reserve disc 16 and a generally horizontally-extending yarn passageway 21 extending through at least a portion of and out of the reverse disc 16 and mating with the vertically-extending yarn passageway 20.

The spindle assembly 10 further includes a carrier mechanism, generally indicated at 25, for carrying a hollow package P of yarn Y and being rotatably mounted on the rotor mechanism 11 by bearings 26 so that the rotor mechanism 11 may rotate relative to the carrier mechanism 25 which is maintained generally stationary. The carrier mechanism 25 includes generally a basket device 27 which surrounds the package P of yarn Y and a hollow yarn package carrier member 28 onto which the hollow package P of yarn Y is supported. The hollow carrier member 28 also includes a hollow yarn entry tube 30 and a rotatably mounted flier mechanism 32 which is free for rotation relative to the yarn entry tube 30. The yarn entry tube 30 extends outwardly from the carrier member 28 axially of the supply package P supported thereon for receiving the yarn Y from the supply package P and providing an axially extending passageway 31 for receiving and allowing passage of the yarn Y therethrough and mating with the hollow interior of the carrier member 28 which provides a passageway 33 for the yarn which mates with the passageways 20 and 21 of the hollow axle 17 and the reserve disc 16.

The spindle assembly 10 further includes a balloon limitor device 34 surrounding the basket device 27 so as to contain a balloon of yarn Y formed around the outside of the basket device 27. A yarn guide eyelet 40 is positioned above and in axial alignment with the yarn entry tube 30. There is further provided take-up mechanisms (not shown) including a traversing device and a take-up roll for taking up and forming a package of the twisted or processed yarn Y produced by the spindle assembly 10. These take-up mechanisms are conventional in a two-for-one twister yarn processing machine and an illustration thereof and further explanation thereof is not believed necessary herein for a full understanding of this invention.

With the above described mechanisms of the spindle assembly 10, the yarn Y passes from the package P, through the rotating flier mechanism 32, into and through the yarn entry tube 30 and its passageway 31, through the passageway 33 of the carrier member 28, through the vertically-extending yarn passageway 20 in the hollow axle device 17, through the horizontally-extending passageway 21 in the reserve disc 16 and out of the reserve disc 16 in a generally horizontal direction. The yarn then passes upwardly between the basket device 27 and the balloon limitor 34 and forms a rotating balloon of yarn which is contained by the balloon limitor device 34. The yarn then passes through yarn guide eyelet 40 and is taken up by the take-up mechanisms. As is well understood by those with ordinary skill in the art, a two-for-one twist is inserted in the yarn during the abovenoted path of travel due to rotation of the rotor mechanism 11 causing rotation of the balloon of yarn Y, described above.

Preferably, the two-for-one twister yarn processing machine includes pneumatically operated yarn threading mechanisms operatively associated with the spindle assembly 10 for selectively threading a yarn through at least a portion of the spindle assembly 10 upon actuation thereof. Such pneumatically operated yarn threading mechanisms for a two-for-one twister of this type are disclosed in the abovementioned U.S. Pat. No. 3,731,478 and reference may be had to that patent for a full disclosure of the construction and operation of such pneumatically operated yarn threading mechanisms.

Generally, the pneumatically operated yarn threading mechanisms include, inter alia, an ejector air nozzle device 42 which selectively is brought into engagement with the reserve disc 16 of the rotor mechanism 11, as indicated in dotted lines in FIG. 1, for causing a positive air stream to flow through the yarn passageway 21 and a negative air stream through the yarn passageways 20, 33, 31 for sucking the yarn Y from the supply package P through the yarn entry tube 30 and its passageway 31, the passageway 33 of the carrier member 28 and the passageway 20 of the hollow axle 17 and blowing the yarn Y out of the passageway 21 of the reserve disc 16. The air stream then engages a generally spoon-shaped deflection guide surface 43 formed on the bottom of the balloon limitor 34 which deflects the air stream and carries it and the yarn Y up through the space between the basket device 27 and the balloon limitor 34 to bring the end of yarn in position for a knotting operation.

At this position, the yarn may be received by a suitable knotter mechanism 45. The knotter mechanism 45, illustrated in FIG. 1, is of the type disclosed in U.S. Pat. No. 3,820,315, issued June 28, 1974 and assigned to the assignee of the present application or may be any suitable type of yarn knotter mechanism, such as, for example, disclosed in U.S. Pat. No. 3,842,580, issued Oct. 22, 1974 or U.S. Pat. No 3,838,875, issued Oct. 1, 1974, both of which are assigned to the assignee of the present invention. Operation of such yarn knotter mechanisms for knotting of the two ends of yarn during threading of the spindle assembly 10 for start-up of the spindle assembly may be obtained from the disclosures of the above patents and are well understood by those of ordinary skill in the art. If knotting of the yarn Y is not required, the yarn may be pneumatically threaded through the guide 40 and take-up mechanisms in accordance with the above-identified U.S. Pat. No. 3,731,478, or may be manually threaded.

In accordance with the present invention, an improved yarn brake mechanism, generally indicated at 50, is positioned in the hollow yarn carrier 28 for applying a desired tension to the yarn passing therethrough during processing of the yarn. This brake mechanism 50 is positioned in an enlarged cavity 51 forming a part of and enlarging the passageway 33 in the carrier member 28. The brake mechanism 50 comprises a stationary braking member 54 positioned in the upper portion of the cavity 51 and forming a generally flat, inclined, braking surface 55 generally around the yarn passageway as it enters the cavity 51. In the embodiment disclosed in the drawings, the stationary braking member 54, also defines a yarn passageway 56 which is generally of the same dimensions and coaxial with the yarn passageway 31 through the yarn entry tube 30 so as to form an extension of that passageway for entering into the enlarged cavity 51 generally centrally of the inclined braking surface 55.

Figure 2:
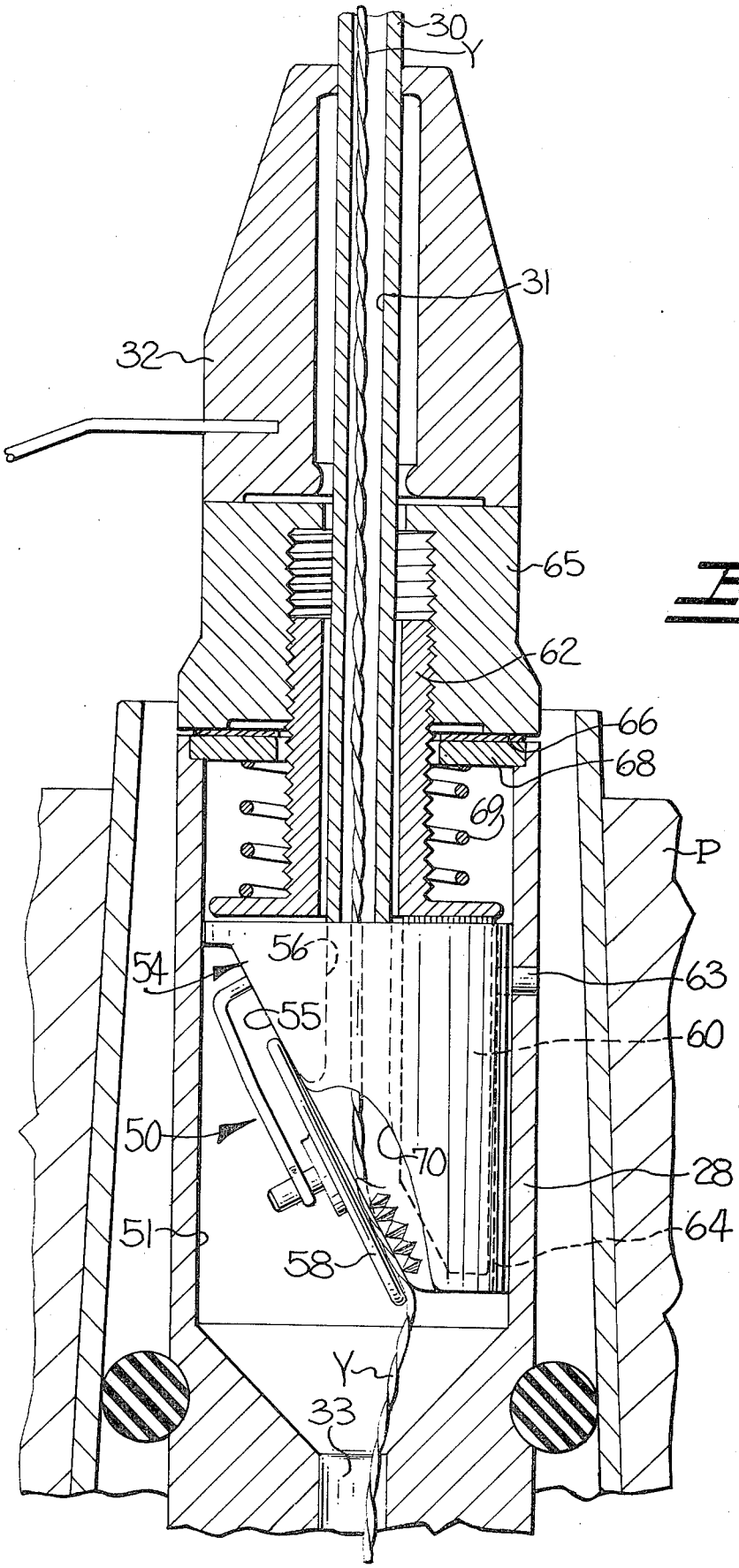
FIG. 2 is an enlarged, cross-sectional, elevational view of a portion of the spindle assembly illustrated in FIG. 1.
Figure 3:
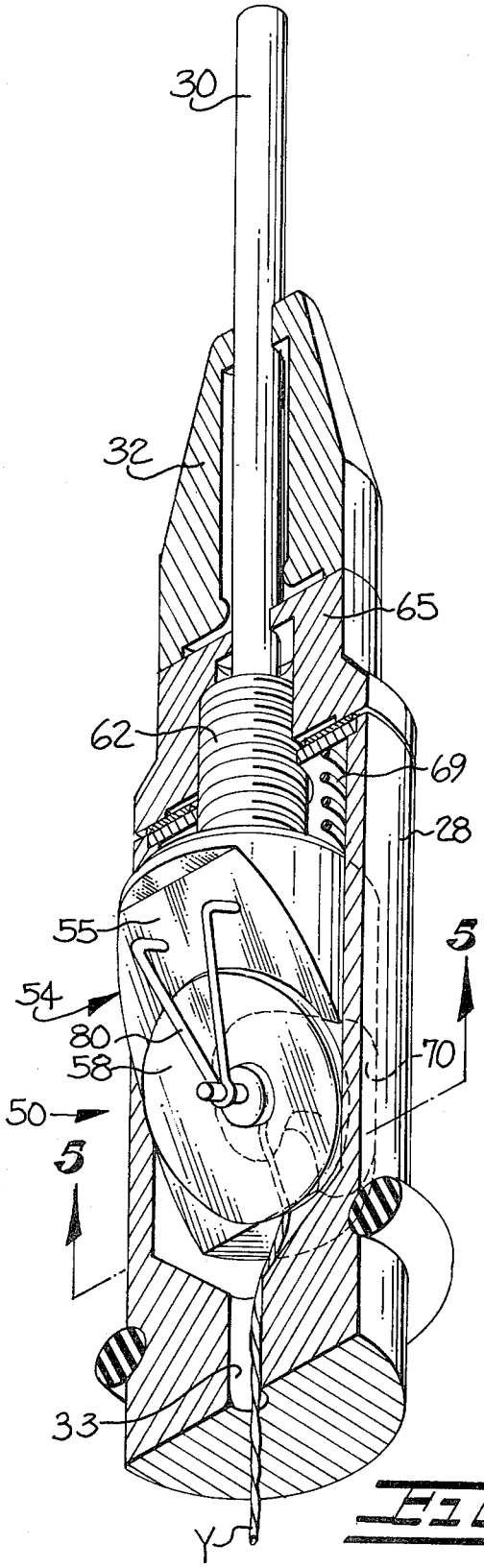
FIG. 3 is a cross-sectional, elevational, perspective view of the hollow yarn carrier mechanism of the spindle assembly illustrated in FIGS. 1 and 2.

The brake mechanism 50 further includes a movable, braking plate 58 of ferromagnetic material pivotally mounted within the cavity 51 for cooperation with the stationary braking surface 55 and for generally covering the passageway 56 at the entrance to the cavity 51, as shown particularly in FIGS. 2 and 3, and for allowing pivoting movement of the movable brake plate 58 toward and away from the stationary braking surface 55.

The movable braking plate 58 is under the force of a multi-pole, axially magnetized, magnet 60 which is adjustably mounted in magnetically attracting proximity to the ferromagnetic braking plate 58 for adjustably biasing the braking plate 58 toward the inclined braking surface 55 for applying a desired, variable tension to yarn Y passing therebetween during yarn processing. The magnet 60 whose bottom is directed parallel to the braking surface 55 is secured against rotation by a hollow, threaded bushing 62 which is secured to the top thereof and which receives the yarn entry tube 30 therein and by a pin 63 which is arranged on the inner wall of the carrier member 28 and engages into an axially directed, longitudinal groove 64 in the magnet 60.

A hollow screw cap member 65 forms a part of the carrier mechanism 28 and is screwed onto the upper end of the threaded bushing 63 by internal threads therein and receives the yarn entry tube 30 through the hollow center thereof. The lower face surface 66 of the screw head member 65 rests on a closure cover 68 of the carrier member 28 while the upper face surface of the screw head member 65 serves as an axial bearing for the rotatably mounted flier mechanism 32. If the screw head member 65 is rotated, the threaded bushing 62, depending upon the direction of rotation, turns either axially into or axially out of the screw head member 65. This axial movement of the threaded bushing 62 takes place under the action of a compression spring 69, which at one end rests on the bottom of the closure cover 68 and at the other end on a supporting shoulder of the threaded bushing 62 to which the magnet 60 is fastened. Thus, by turning the screw head member 65, the magnet 60 may be raised or lowered and the bias of the magnet 60 on the movable braking plate 58 may be adjusted. It is clear that, as the yarn Y passes through the passageway 31 of the yarn entry tube 30 and the passageway 56 and into the enlarged cavity 51, the yarn will be forced between the biased, pivotally mounted, braking plate 58 and the stationary braking surface 55 so that a tension will be placed on the yarn in accordance with the adjusted position of the magnet 60 toward or away from the braking plate 58.

In accordance with this invention, the yarn brake mechanism 50 further includes a yarn bypass channel 70 formed in the stationary braking member 54 and leading from the passageway 56 at the entrance to the cavity 51 and laterally alongside the stationary braking surface 55 for receiving the yarn Y during the above-described pneumatic threading of the yarn Y through the passageways 31, 56, 33, 20, 21 for start-up of the spindle assembly 10 prior to yarn processing and eliminating the passage of the yarn Y between the braking surface 55 and the braking plate 58 during such pneumatic threading.

Figure 4:
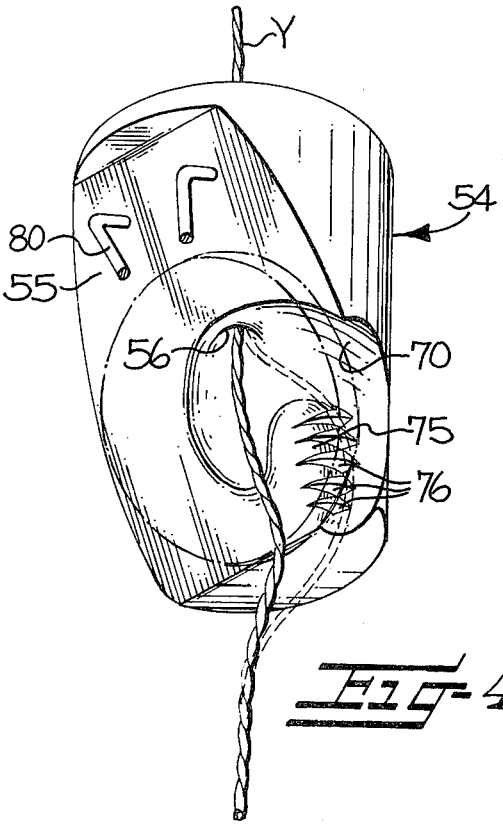
FIG. 4 is a perspective view of the stationary braking member, with the movable braking plate removed for clarity, as illustrated particularly in FIG. 3.
Figure 5:
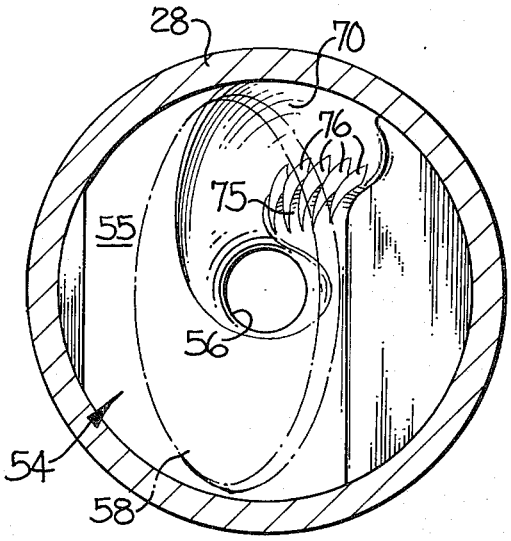
FIG. 5 is a cross-sectional view, taken generally along the line 5—5 of FIG. 3.
Figure 6:
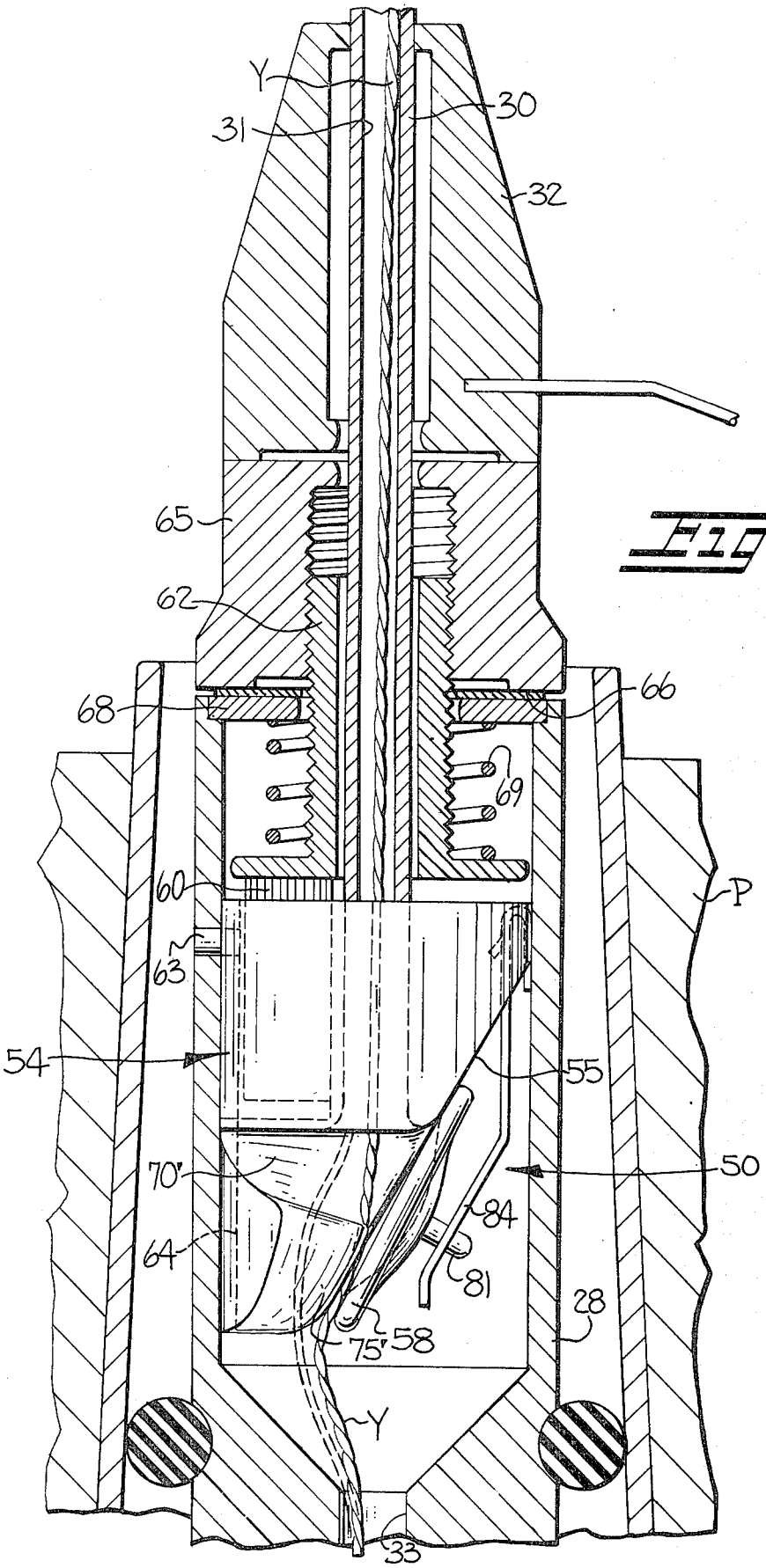
FIG. 6 is a cross-sectional view, somewhat like FIG. 2 but taken from the other side, illustrating an alternate embodiment of this invention.
Figure 7:
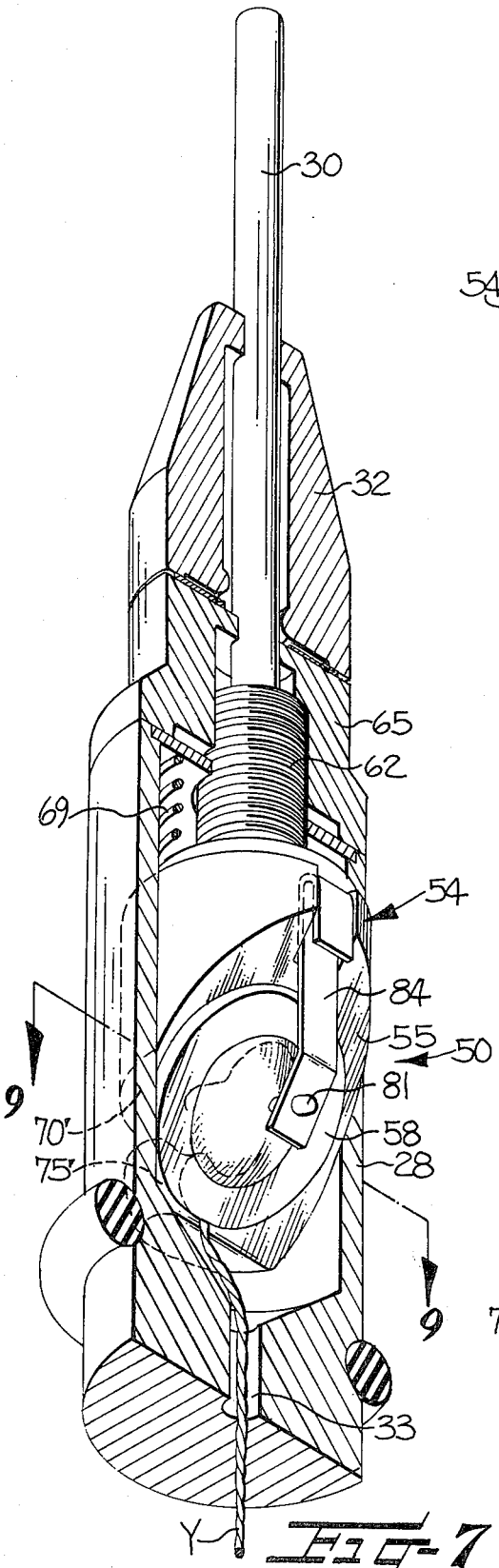
FIG. 7 is a cross-sectional view, somewhat like FIG. 3 but taken from the other side, of the alternate embodiment of this invention illustrated in FIG. 6.
Figure 8:
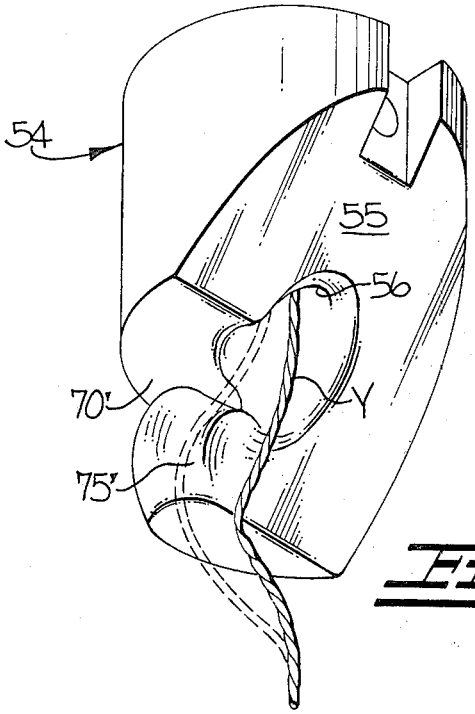
FIG. 8 is a perspective view, somewhat like FIG. 4 but taken from the other side, of the stationary braking member of the alternate embodiment of FIGS. 6 and 7.

In accordance with the embodiment of FIGS. 1–5, this bypass channel 70 is in the form of a depression in the braking member 54 which extends laterally of the normal yarn passage through the above-defined passageways and extends obliquely downwardly, as shown particularly in FIG. 4. The depression forming the bypass channel 70 extends laterally to and beyond the periphery of the braking plate 58. Accordingly, during pneumatic threading of yarn Y through the carrier mechanism 28 of the spindle assembly 10, the yarn Y will be diverted from its normal path of travel and sucked through the bypass channel 70, as indicated in dotted lines in FIG. 4, so that the braking plate 58 will not have to be positively moved away from the stationary braking surface 55 for such pneumatic threading.

After pneumatic threading of the yarn Y, knotting of the yarn Y by the knotter 45, if required, and upon start-up of the spindle assembly 10 for processing of the yarn Y, the yarn Y will necessarily be made taut or will have a tension put thereon by the yarn processing which will tend to force the yarn Y out of the bypass channel 70 and into its normal path of travel between the brake plate 58 and the braking surface 55. To aid in this movement, the brake mechanism 50 of this invention further includes an obliquely extending, deflection surface 75 formed in the stationary braking member 54 between the bypass channel 70 and the inclined braking surface 55 for deflecting the yarn Y from the bypass channel 70 into its normal position between the braking surface 55 and the braking plate 58.

In the embodiment of the invention illustrated in FIGS. 1–5, this deflection surface 75 includes inclined, transversely and downwardly extending grooves 76 which extend between the bypass channel 70 and the braking surface 55 for facilitating the deflection of the yarn Y therebetween.

In the embodiment of the yarn brake mechanism 50 illustrated in FIGS. 6–9, the bypass channel 70′ is opened toward the side and rear with reference to the braking surface 55 and makes it possible, upon pneumatic threading of the yarn Y, for the yarn Y to be moved laterally past the braking surface 55. The deflection surface 75' of the embodiment of FIGS. 6–9 is in the form of a projection which is arranged laterally of the braking surface 55 and has essentially the shape of a wedge whose front deflection surface passes obliquely into the braking surface 55. This deflection surface is, as a whole, shaped in such a manner that the yarn Y, regardless of its path in case of tension acting on the yarn, slides over the front deflection surface of the wedge shaped projection in the direction toward the braking surface 55.

The movable braking plate 55 of both embodiments is preferably in the form of a generally circular plate which extends at least partially over, but not in contact with, the deflection surface 75 or 75' and is rotatably mounted for rotation during deflection of the yarn Y by the deflection surface 75 or 75' from the bypass channel 70 or 70' into position between the braking surface 55 and the braking plate 58 for facilitating such deflection. As shown in the embodiment of FIGS. 1–5, the generally circular braking plate 58 may be pivotally and rotatably mounted by a generally V-shaped, flexible yoke 80 having the two upper ends thereof secured to the stationary braking member 54 and receiving a pin 81 at the bottom thereof which is secured generally to the center of the circular braking plate 58 for rotatably and pivotally mounting same. In the embodiment of FIGS. 6–9, the generally circular braking plate 58 is rotatably and pivotally mounted by a flexible lever 84 which is secured at its upper end to the stationary braking member 54 and has an aperture in the bottom thereof for receiving the pin 81 and mounting the braking plate 58 for rotary movement with respect thereto.

Figure 9:
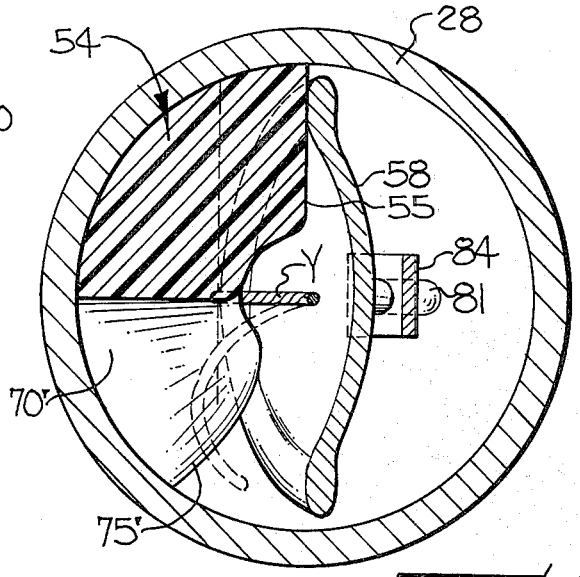
FIG. 9 is a cross-sectional view, taken generally along the line 9—9 of FIG. 7.

In either of the embodiments of FIGS. 1–5 or 6–9, the generally circular braking plate 58 may include a generally concave braking surface, as shown particularly in FIG. 9, in which only the outer peripheral edges thereof cooperate with the stationary braking surface 55 for applying tension to the yarn Y and facilitate deflection of the yarn by the deflection surface 75 and 75' from the bypass channel 70 or 70' into position between the braking plate 58 and the braking surface 55. This concave construction allows easier passage of the yarn Y into such position.

The remaining elements of the brake mechanism 50 of the embodiment of FIGS. 6–9 is the same as that illustrated in the embodiment of FIGS. 1–5 and like reference characters have been applied to these elements.

Thus, this invention has provided an improved yarn brake mechanism 50 for the spindle assembly 10 which allows self-threading of the yarn Y therethrough during threading of the yarn Y through the spindle assembly 10 for start-up of the spindle assembly 10 prior to yarn processing and which eliminates any positive movement of the movable brake plate 58 from the stationary braking surface 55 for such threading up operation.

In the drawings and specification, there have been set forth preferred embodiments of this invention and, although specific terms are employed, they are used in a generic and descriptive sense only and not for purposes of limitation.

What is claimed is:

1. In a textile yarn processing machine, such as a two-for-one twister and the like, having spindle assemblies for the processing of yarn and each including a carrier mechanism for carrying a package of yarn to be withdrawn and processed and defining an elongate passageway therethrough for the yarn withdrawn from the package and an enlarged cavity forming a part of and enlarging said passageway at said cavity; the combination therewith of an improved yarn brake mechanism positioned in said cavity for applying a desired tension to the yarn passing therethrough and being characterized by a self-threading construction, said yarn brake mechanism comprising:

a stationary braking member in the upper portion of said cavity and forming a generally flat, inclined braking surface generally around said passageway at the entrance to said cavity;

a movable braking plate pivotally mounted within said cavity for cooperation with said stationary braking surface and for generally covering said passageway at the entrance to said cavity and including means for adjustably biasing said braking plate toward said inclined braking surface for applying a desired tension to yarn passing therebetween during processing;

a yarn bypass channel formed in said stationary braking member and leading from said passageway at the entrance to said cavity and laterally alongside said stationary braking surface for receiving the yarn during threading of the yarn through said passageway for start-up of said spindle assembly prior to yarn processing and eliminating passage of the yarn between said braking surface and braking plate during threading; and an obliquely extending, deflection surface formed in said stationary braking member between said bypass channel and said inclined braking surface for deflecting the yarn from said bypass channel into position between said braking surface and braking plate after threading of the yarn and during start-up of said spindle assembly.

2. In a textile yarn processing machine, as set forth in claim 1 in which said deflection surface includes inclined, transversely and downwardly extending grooves therein for aiding in deflecting the yarn from said bypass channel into position between said braking surface and braking plate after threading of the yarn for start-up of said spindle assembly.

3. In a textile yarn processing machine, as set forth in claim 1 in which said deflection surface comprises a generally wedge shaped projection extending between said bypass channel and said inclined braking surface.

4. In a textile yarn processing machine, as set forth in claim 1 in which said braking plate comprises a generally circular plate which extends at least partially over, but not in contact with, said deflection surface and includes means for rotatably mounting said braking plate for rotation during deflection of the yarn by said deflection surface from said bypass channel into position between said braking surface and braking plate for facilitating such deflection.

5. In a textile yarn processing machine, as set forth in claim 1 in which said braking plate comprises a generally circular plate which extends at least partially over, but not in contact with, said deflection surface and includes a generally concave braking surface for cooperation with said stationary braking surface at the outer edges thereof and for facilitating deflection of the yarn by said deflection surface from said bypass channel into position between said stationary braking surface and said braking plate.

6. In a textile yarn processing machine, such as a two-for-one twister and the like, having spindle assemblies for the processing of yarn and each including a carrier mechanism for carrying a package of yarn to be withdrawn and processed and defining an elongate passageway therethrough for the yarn withdrawn from the package, an enlarged cavity forming a part of and enlarging said passageway at said cavity, and pneumatic means for threading yarn through said passageway for start-up of said spindle assembly prior to yarn processing; the combination therewith of an improved yarn brake mechanism positioned in said cavity for applying a desired tension to the yarn passing therethrough and being characterized by a self-threading construction, said yarn brake mechanism comprising:

a stationary braking member in the upper portion of said cavity and forming a generally flat, inclined braking surface generally around said passageway at the entrance to said cavity;

a movable, ferromagnetic, braking plate pivotally mounted within said cavity for cooperation with said stationary braking surface and for generally covering said passageway at the entrance to said cavity;

magnet means adjustably mounted in magnetically attracting proximity to said ferromagnetic braking plate for movement closer to and away from said braking plate for adjustably biasing said braking plate toward said inclined braking surface for applying a desired tension to yarn passing therebetween during processing;

a yarn bypass channel formed in said stationary braking member and leading from said passageway at the entrance to said cavity and laterally alongside said stationary braking surface for receiving the yarn during pneumatic threading of the yarn through said passageway for start-up of said spindle assembly prior to yarn processing and eliminating the passage of the yarn between said braking surface and braking plate during pneumatic threading; and an obliquely extending, deflection surface formed in said stationary braking member between said bypass channel and said inclined braking surface for deflecting the yarn from said bypass channel into position between said braking surface and braking plate after pneumatic threading of the yarn and upon additional tension being placed upon the yarn during start-up of said spindle assembly.

7. In a textile yarn processing machine, as set forth in claim 6 in which said deflection surface includes inclined, transversely and downwardly extending grooves therein for aiding in deflecting the yarn from said bypass channel into position between said braking surface and braking plate after threading of the yarn for start-up of said spindle assembly.

8. In a textile yarn processing machine, as set forth in claim 6 in which said deflection surface comprises a generally wedge shaped projection extending between said bypass channel and said inclined braking surface.

9. In a textile yarn processing machine, as set forth in claim 6 in which said braking plate comprises a generally circular plate which extends at least partially over, but not in contact with, said deflection surface and includes means for rotatably mounting said braking plate for rotation during deflection of the yarn by said deflection surface from said bypass channel into position between said braking surface and braking plate for facilitating such deflection.

10. In a textile processing machine, as set forth in claim 6 in which said braking plate comprises a generally circular plate which extends at least partially over, but not in contact with said deflection surface and includes a generally concave braking surface for cooperation with said stationary braking surface at the outer edges thereof and for facilitating deflection of the yarn by said deflection surface from said bypass channel into position between said stationary braking surface and said braking plate.

* * * * *